US007849917B2

(12) United States Patent
Grant

(10) Patent No.: US 7,849,917 B2
(45) Date of Patent: Dec. 14, 2010

(54) MARGINAL OIL EXTRACTION DEVICE

(76) Inventor: Michael E. Grant, 1206 18th St., Spirit Lake, IA (US) 51360

( * ) Notice: Subject to any disclaimer, the term of this patent is extended or adjusted under 35 U.S.C. 154(b) by 38 days.

(21) Appl. No.: 12/250,160

(22) Filed: Oct. 13, 2008

(65) Prior Publication Data

US 2009/0032239 A1 Feb. 5, 2009

Related U.S. Application Data

(62) Division of application No. 11/363,712, filed on Feb. 27, 2006, now Pat. No. 7,481,271.

(51) Int. Cl.
*E21B 34/06* (2006.01)

(52) U.S. Cl. ..... 166/165; 166/320

(58) Field of Classification Search ..... 166/369, 166/165, 168, 319, 320
See application file for complete search history.

(56) References Cited

U.S. PATENT DOCUMENTS

| | | | | |
|---|---|---|---|---|
| 2,623,595 | A | 12/1952 | West | |
| 3,461,960 | A | 8/1969 | Wilson | |
| 4,086,035 | A | 4/1978 | Klaeger, Jr. | |
| 4,368,909 | A | 1/1983 | Alexander | |
| 4,745,942 | A * | 5/1988 | Delwiche | 137/172 |
| 5,421,631 | A | 6/1995 | Murray | |
| 6,431,272 | B1 | 8/2002 | Pratt | |
| 6,601,889 | B2 | 8/2003 | Pratt | |
| 6,615,294 | B1 | 9/2003 | Yamanoi | |
| 6,979,033 | B2 | 12/2005 | Pratt | |
| 7,028,564 | B2 | 4/2006 | Voss | |
| 7,290,606 | B2 * | 11/2007 | Coronado et al. | 166/250.15 |
| 2002/0104648 | A1 | 8/2002 | Pratt | |

* cited by examiner

*Primary Examiner*—William P Neuder
(74) *Attorney, Agent, or Firm*—Vidas, Arrett & Steinkraus, P.A.

(57) ABSTRACT

A marginal oil extraction system having an upper extraction unit, an extraction container, and a lower valve assembly. The marginal oil extraction system uses at least some of these components to cheaply extract oil from a stripper oil well. In some cases the system is capable of separating the oil from the water in the well with a solid barrier and can cheaply remove the oil from above the solid barrier. The system is cheap to install, easy to maintain and provides efficient access to what would otherwise be an inaccessible asset.

4 Claims, 15 Drawing Sheets

MARGINAL OIL EXTRACTION DEVICE

CROSS-REFERENCE TO RELATED APPLICATIONS

This application is a Divisional application of U.S. patent application Ser. No. 11/363,712, the entire content of which is incorporated by reference herein.

STATEMENT REGARDING FEDERALLY SPONSORED RESEARCH

Not Applicable

BACKGROUND OF THE INVENTION

Field of the Invention

In some embodiments this invention relates to a method for more inexpensively extracting a particularly desired liquid from a reservoir containing two or more kinds of liquids. In at least one possible embodiment this invention is drawn to extracting oil from an oil well and in at least one possible embodiment this invention is drawn to more inexpensively extracting oil from a "stripper" well.

Over time as oil is pumped from a well, the marginal cost of retrieving oil increases. This is because the ascending pressure on the oil decreases increasing the cost of extraction, and because water infiltrates into the well which results in unwanted high water content in the yield from the well. Eventually this process leads to the well being defined as a "stripper well" meaning that the cost of extracting the oil from the well is higher than desired. The oil contained in a stripper well is sometimes referred to as marginal oil. When the current market value of oil is low, retrieval of marginal oil by current methods of extraction can be cost prohibitive. In addition, even when the current market value of oil is high, it is still desirable to be able to retrieve oil without the need for additional expenses including those caused by the need to remove water from the oil. In some contexts, if an oil well is only capable of producing 10 or fewer barrels of oil a day it is categorized as a stripper well.

The marginal oil reserves are unlike other oil reserves. Because oil extraction companies have maintained meticulous geological and production records of stripper wells operations, the exact locations and true oil volumes of marginal oil reserves are known. As a result extracting oil from these wells involves no exploration costs or drilling costs. It is estimated that between 3000 and 5000 oil bearing stripper wells are capped every year and in the United States there are over 400,000 oil bearing stripper wells. In addition, application of this technology to known U.S. stripper wells could help the US achieve energy independence.

Although a number of prior technologies have been developed to attempt to recover the oil contained in stripper wells, these technologies have not been wholly satisfactory in extracting marginal oil in a cost effective manner. One such technology is a bailing device such as those described in U.S. Pat. Nos. 6,979,033, 6,601,889, 5,421,631, 4,086,035, 4,368,909, and published U.S. application 2005/0126313A1. Bailing devices involve lowering a bailing bucket into a well, allowing it to fill with oil, and then extracting the bailing bucket. The Prior Art bailing devices are unsatisfactory because as the bailing bucket descends it doesn't allow for the easy displacement of air below the bucket and its descent causes an increase in air pressure within the well. In a stripper well, this increased pressure has the effect of pushing the marginal oil away from the bucket and down into the water layer. The displaced oil then mixes with sub-oil water producing an oil-water mixture. Typically the liquid yield of these bailing devices includes a high proportion of the oil-water mixture which results in the need for an additional expensive separation step. In addition, because oil is more viscous than water it is it flows more slowly against the increased air pressure so water tends to predominate the liquids that end up in the bailing bucket.

Another unsatisfactory technology is disclosed in U.S. Pat. No. 6,615,924 and published U.S. application 202/0104648 which describe devices in which the velocity of the descending bailing bucket are controlled to improve yield. Unfortunately, these technologies also do not adequately address the high water yield problem caused by waters lower viscosity. As a result there is a clear need for a novel device capable of extracting valuable proven oil reserves from stripper wells.

The art referred to and/or described above is not intended to constitute an admission that any patent, publication or other information referred to herein is "prior art" with respect to this invention. In addition, this section should not be construed to mean that a search has been made or that no other pertinent information as defined in 37 C.F.R. §1.56(a) exists.

Without limiting the scope of the invention a brief summary of some of the claimed embodiments of the invention is set forth below. Additional details of the summarized embodiments of the invention and/or additional embodiments of the invention may be found in the Detailed Description of the Invention below.

A brief abstract of the technical disclosure in the specification is provided as well only for the purposes of complying with 37 C.F.R. 1.72. The abstract is not intended to be used for interpreting the scope of the claims.

All U.S. patents and applications and all other published documents mentioned anywhere in this application are incorporated herein by reference in their entirety.

BRIEF SUMMARY OF THE INVENTION

This invention contemplates a number of embodiments where any one, any combination of some, or all of the embodiments can be incorporated into an oil extraction system. These embodiments can be applied to both stripper wells as well as other types of oil containing wells and reservoirs.

At least one embodiment of the inventive concept is directed towards an oil extraction system for the removal of oil from an oil well, the system comprising an upper extraction unit, an extraction container, and a sealing member engaged to the extraction container. The upper extraction unit has a lifting mechanism connected to the extraction container and is capable of lowering the extraction container into and lifting the extraction container out of an oil well. The extraction container has a top, a bottom, defines a volume capable of storing fluid, and is constructed and arranged to have an open configuration and a closed configuration. The sealing member regulates the flow of fluids along the outside of the container between the top and the bottom of the container.

At least one embodiment of the inventive concept is directed towards an oil extraction system further comprising a side in which the sealing member can flexibly pivot relative to the side. The sealing member is capable of pivotably transitioning between a more vertical orientation and a more horizontal orientation. The sealing member allows fluids to pass more freely along the outside of the container when the sealing member is in the vertical orientation than when the sealing member is in the horizontal orientation.

At least one embodiment of the inventive concept is directed towards an oil extraction system further comprising a sealing member having a ring substantially surrounding the side, at least one upper seal support, and a connector ring. At least a portion of the connector ring is engaged to the extraction container and at least a portion of the connector ring is engaged to the upper seal. At least a portion of the upper seal support is engaged to the connector ring and at least a portion of the connector ring is engaged to the upper seal. The upper seal is more flexible than the upper seal support.

At least one embodiment of the inventive concept is directed towards an oil extraction system further comprising a sealing member which allows fluids to pass more freely along the side of the extraction container when the extraction container is descending into an oil well than when the extraction container is ascending in an oil well. The ascending extraction container at least partially effects a fluidic pressure differential characterized by a lower fluidic pressure beneath the extraction container than above the extraction container.

At least one embodiment of the inventive concept is directed towards an oil extraction system for the removal of oil from an oil well casing, the system comprising an upper extraction unit, and an extraction container. The upper extraction unit has a lifting mechanism connected to the extraction container and is capable of lowering the extraction container into and lifting the extraction container out of an oil well casing. The extraction container defines an inner volume capable of storing fluid and has a bottom, an impact reactive trigger, and at least one closable opening positioned at the bottom. The at least one closable opening is in fluid communication with the inner volume and when open is in fluid communication with fluid outside of the extraction container. The impact reactive trigger is capable of transitioning the at least one closeable opening between an open and a closed configuration with a lever action when a significant pressure is applied to the impact reactive trigger.

At least one embodiment of the inventive concept is directed towards an oil extraction system further comprising a sealing plate, a travel guide, and a travel stop. The travel guide is engaged to the bottom and has a length. The travel stop is positioned at point along the length not congruent with the bottom. The bottom defines a solid portion through which the at least one opening completely runs through. The sealing plate also has a solid portion and at least one opening running through the solid portion. The sealing plate is slidably engaged to the travel guide and can slide along the length from a position abutting the bottom to a position abutting the travel stop. The at least one opening in both the bottom and the sealing plate are positioned so that when the sealing plate abuts the bottom, the at least one opening of each faces the solid portion of each.

At least one embodiment of the inventive concept is directed towards an oil extraction system further comprising an impact reactive trigger which opens the closeable opening by levering the sealing plate away from the bottom.

At least one embodiment of the inventive concept is directed towards an oil extraction system further comprising a sealing plate which abuts the bottom in the absence of any significant force applied to the impact reactive trigger. An impact between the impact reactive trigger and a solid object provides sufficient force to lever the sealing plate away form the bottom.

At least one embodiment of the inventive concept is directed towards an oil extraction system for the removal of oil from an oil well casing, the system comprising an upper extraction unit and an extraction container. The upper extraction unit has a structural assembly for supporting components of the extraction system and a lifting mechanism. The lifting mechanism is engaged to the structural assembly, is connected to the extraction container, and is capable of lowering the extraction container into and lifting the extraction container out of an oil well casing. The extraction container defines a volume capable of storing fluid, has two configurations, one being an open configuration and a one being closed configuration. The extraction container also has a bottom a sealing member adjacent to the bottom and a trigger. The trigger has a first position assumed when no pressure is applied to it and a second position assumed when pressure is applied to it. The trigger is in levered contact with the bottom and the sealing member. The extraction container assumes the open configuration when the trigger levers the sealing member away from the bottom when in the second position.

At least one embodiment of the inventive concept is directed towards an oil extraction system further comprising a first position which is linear relative to an axis extending along the length of the extraction container and the second position which is at an angle to the axis.

At least one embodiment of the inventive concept is directed towards an oil extraction system further comprising a releasing trigger engaged to the structural assembly. The releasing trigger engages the extraction container trigger when the extraction container is removed from the oil well casing.

At least one embodiment of the inventive concept is directed towards an oil extraction system further comprising a tilted strike plate engaged to the structural assembly. The tilted strike plate can tilt the extraction container into a tilted position when the bucket is lifted out of an oil well casing. The extraction container trigger can engage the releasing trigger when the extracted container is in a tilted position.

At least one embodiment of the inventive concept is directed towards an oil extraction system further comprising a funnel engaged to the structural assembly. The funnel is positioned under the sealing member when the extraction container is in a tilted position. The funnel is connected to a storage reservoir.

At least one embodiment of the inventive concept is directed towards an oil extraction system further comprising a storage reservoir in which the reservoir further comprises a closable pipe engaged to the reservoir and extending to the oil pipe casing.

At least one embodiment of the inventive concept is directed towards an oil extraction system further comprising a controller device which controls the speed of the lifting mechanism and the time at which the extraction container remains within the oil pipe casing.

At least one embodiment of the inventive concept is directed towards an oil extraction system further comprising an impact object. The impact object is positioned within the oil pipe casing of the oil well at a point below the structural assembly. The extraction container trigger assumes the second position when coming into contact with the impact object.

At least one embodiment of the inventive concept is directed towards an oil extraction system further comprising a lower valve assembly. The lower valve assembly is an impact object and has a body with an interior, a top, and a bottom, a through passage extending through the body from an upper opening to a lower opening, and a rotating seal. The through passage has at least two segments each segment having portions and each segment being in fluid communication with each other. The at least two segments comprise a first segment and a second segment. The first segment defines a section of the through passage extending from the upper opening down into the interior. The second segment defines a section of the through passage extending from the interior to the lower opening. The rotating seal is engaged to and in fluidic communication with both the first and the second segments. The portions of the first segment and second segment are engaged to the rotating seal and are in a non-linear orientation relative to each other. The rotating seal has a specific density greater than water but less than oil. The rotating seal has an open configuration allowing for the passage of fluid and a closed configuration preventing the passage of fluid. The rotating seal assumes an open configuration when the rotating seal is rotated in a first direction in response to the buoyant forces produced when in contact with water, and assumes a closed configuration when the rotating seal is rotated in a second direction in response to the anti-buoyant forces produced when in contact with oil.

At least one embodiment of the inventive concept is directed towards a lower valve assembly capable of being installed within an oil pipe casing. The valve assembly has a body with an interior, a top, and a bottom, a through passage extending through the body from an upper opening to a lower opening, and a rotating seal. The through passage has at least two segments each segment having portions and each segment being in fluid communication with each other. The at least two segments comprise a first segment and a second segment. The first segment defines a section of the through passage extending from the upper opening down into the interior. The second segment defines a section of the through passage extending from the interior to the lower opening. The rotating seal is engaged to and in fluidic communication with both the first and the second segments. The portions of the first segment and second segment engaged to the rotating seal are in a non-linear orientation relative to each other. The rotating seal has a specific density greater than water but less than oil. The rotating seal has an open configuration allowing for the passage of fluid and a closed configuration preventing the passage of fluid. The rotating seal assumes an open configuration when the rotating seal is rotated in a first direction in response to the buoyant forces produced when in contact with water. The rotating seal assumes a closed configuration when the rotating seal is rotated in a second direction in response to the anti-buoyant forces produced when in contact with oil.

At least one embodiment of the inventive concept is directed towards a lower valve assembly capable of being installed within an oil pipe casing further comprising spin locks engaged to the body, a wedge screw in mechanical communication with a wedge screw drive, and wedge grapplers. The wedge grapplers have two configurations one being a contained configuration in which the grapplers are substantially contained within the body and one being an expanded configuration in which the grapplers extend out of the body. In the expanded configuration, the grapplers engage the inner surface of the oil pipe casing.

At least one embodiment of the inventive concept is directed towards a lower valve assembly capable of being installed within an oil pipe casing the valve having a body with an interior, a top, and a bottom, a through passage extending through the interior from an upper opening to a lower opening, and a floating seal. The floating seal is engaged to and in fluidic communication with lower opening. The floating seal has a density greater than water but less than oil. The floating seal has an open configuration allowing for the passage of fluid and a closed configuration preventing the passage of fluid. The floating seal assumes an open configuration when the floating seal is lifted by the buoyant forces produced when in contact with water. The floating seal assumes a closed configuration when the floating seal sinks in response to the anti-buoyant forces produced when in contact with oil.

BRIEF DESCRIPTION OF THE SEVERAL VIEWS OF THE DRAWINGS

The invention is best understood from the following detailed description when read in connection with accompanying drawings, in which.

DETAILED DESCRIPTION OF THE INVENTION

Figure 1:
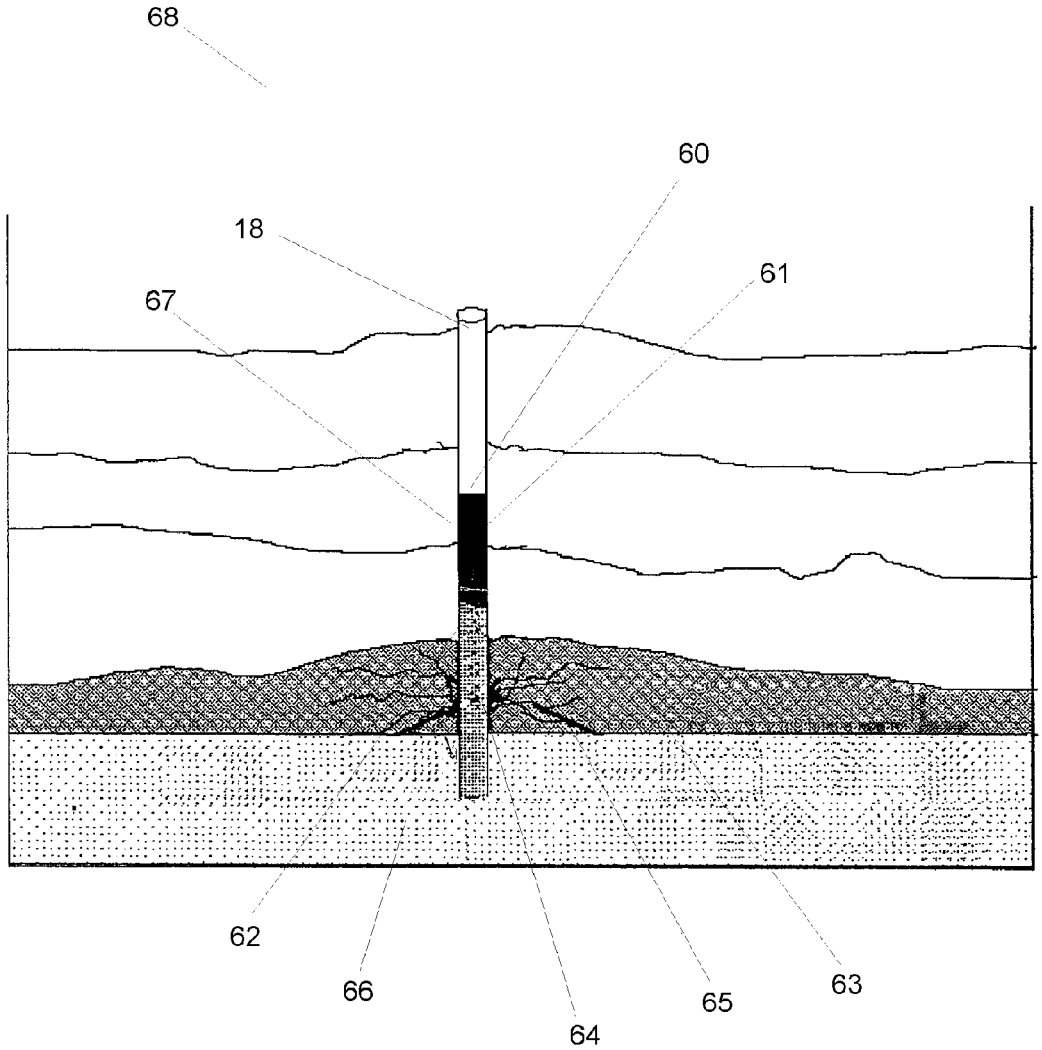
FIG. 1 is a perspective view of a stripper well into which the extractor can be installed.

The invention will next be illustrated with reference to the figures wherein the same numbers indicate similar elements in all figures. Such figures are intended to be illustrative rather than limiting and are included herewith to facilitate the explanation of the apparatus of the present invention.

For the purposes of this disclosure, like reference numerals in the figures shall refer to like features unless otherwise indicated. In addition, as commonly used in scientific references, the term "fluid" refers to matter in a gaseous and/or a liquid state. Fluid includes but is not limited to oil, water, liquids in an oil well, and air.

Depicted in the figures are various aspects of the invention. Elements depicted in one figure may be combined with, or substituted for, elements depicted in another figure as desired. The various embodiments described below teach a device which is inexpensive to install and maintain, and can provides trouble free operation. In addition, these embodiments address aerodynamic and physical considerations have been overlooked by similar methods which have for years been tried and failed.

Although many of the following mentioned embodiments are drawn specifically to extracting oil from an oil well, oil extraction and marginal oil extraction in particular are by no means the only possible applications of these various inventive concepts. The disclosed inventive concepts can be applied to any number of different circumstances including but not limited to those where a particular liquid needs to be retrieved from a reservoir or where it is advantageous to separate or filter liquid layers.

Referring now to FIG. 1 there is shown, a stripper well (68) having a casing (18) which comprises a spout at the top of a pipe (67) extending down though the well. Because oil has a lower density than water however, any oil (61) in the well remains above water (62) in the well. At some point along the pipe (67) is a point of hydrostatic equilibrium (60) which defines the equilibrium point at which the column of water (62) comes at rest due to the weight of an overlying column of oil (61). Although stripper wells do contain a column of oil (61), the volume of this oil relative to the volume of water (62) in the well is low compared to high yield well. As the oil bearing portion of the ground formation (63) becomes largely depleted of oil, the water from the water bearing portion of the rock formation (66) seeps into the pipe (67) and can raise the point of hydrostatic equilibrium (60). The objective of an oil bailing device is to remove the oil with as little of a disruption to the hydrostatic equilibrium (60).

When a prior art type bailing device lowers a bucket into the stripper well (68) it causes a pressure wave to form below it because as it descends, it pushes the air below it down into the well (68) faster than the air can be displaced upwards. Because a bucket often descends at speeds as much as 20 miles/hour it's descent generates significant downwards pressure which pushes on the column of oil (61). The column of oil (61) responds to the pressure by either pushing oil up the sides of the pipe (67) away from the bailer device or down into the column of water (62). In addition, because water has a lower viscosity than oil it can more readily resist the pressure and it rises up into the oil column (61). As a result, the equilibrium between the oil and water is disrupted, and the fluid located near the bailer tends to become a water-oil mixture. This mixture often has so low an oil content as to be economically unfavorable to extract.

At least one embodiment of this invention is directed to a novel marginal oil extractor having three primary components, 1) an upper extraction unit, 2) an extraction container (or bucket), and 3) a lower valve assembly. The lower valve assembly efficiently separates the oil column (61) from the water column (62) and prevents their mixture. The upper extraction unit lowers the extraction container into the separated oil column (61), raises the extraction container when it is at least partially filled with oil and transfers the removed oil to a storage container. As will be explained in detail in subsequent paragraphs, each of these three components address a number physical constraints inherent the extraction of marginal oil.

FIGS. 2-5 illustrate a lower valve assembly (57). The lower valve assembly (57) is installed in the existing pipe (67 of FIG. 1) below the oil column (61 of FIG. 1). In one possible embodiment of this inventive concept, the lower valve assembly is installed above the perforations (64 of FIG. 1) through which oil enters the well from the oil bearing region of the ground (63 of FIG. 1) of the existing casing (18 of FIG. 1). In one possible embodiment the lower valve assembly is installed at or near the point of hydrostatic equilibrium. The lower valve assembly has a fluid flow path (45) allowing a desired fluid (water or oil) to flow through the lower valve assembly (57) to a desired location generally along a longitudinal axis (46). In at least one possible embodiment, the lower valve assembly (57) comprises lifters and spin locks (45) which can be engaged to an installing mechanism. The installing mechanism descends with the lower valve assembly (57) to an appropriate depth between the oil level and the oil intake area. This invention also encompasses other mechanisms of introducing a device to a particular location in an oil well currently known in the art.

One method of facilitating proper positioning of the lower valve assembly is as follows: The lower valve assembly is lowered by a cable into the well pipe. The lower valve assembly can be connected to the cable by hooks engaged to the upper surface of the lower valve assembly or in any other manner known in the art. Also on the cable a relatively short distance above the lower valve assembly is a balloon apparatus. When the lower valve assembly reaches the appropriate depth, the balloon apparatus is inflated. This will prevent any significant up or down vertical motion in the lower valve assembly regardless of any slackening, stretching or other tension related springing motions present in the lowering cable. The balloon apparatus can be deflatable and re-inflatable for multiple re-positioning to assure precise positioning and adjustment of the lower valve assembly within the well. The cable can also have a camera or other oil detecting device to determine when the proper depth has been reached and to determine whether the balloon should be inflated or deflated.

In at least one possible embodiment, the lower valve assembly becomes engaged to the inner wall of the oil pipe casing by grapplers (49). The types of grapplers contemplated by this inventive concept include but are not limited to adhesive, suction or pressure based grapplers or any other grappling device known in the art. In some possible embodiments the grapplers are deployed by screws. In some possible embodiments, the grapplers are daggers (42) capable of either exerting pressure on the inner walls of the pipe casing or of penetrating the inner walls of the casing.

Figure 2:
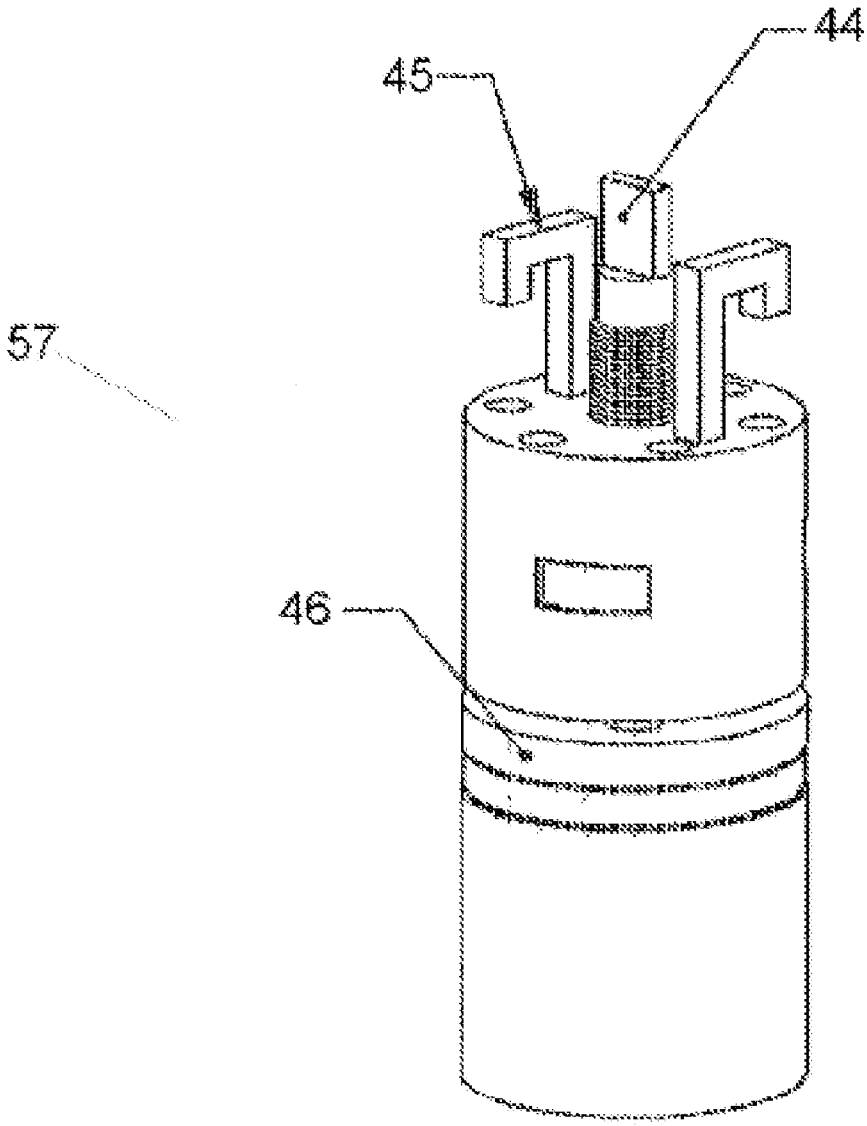
FIG. 2 is an image of a lower valve assembly in an unlocked position.
Figure 3:
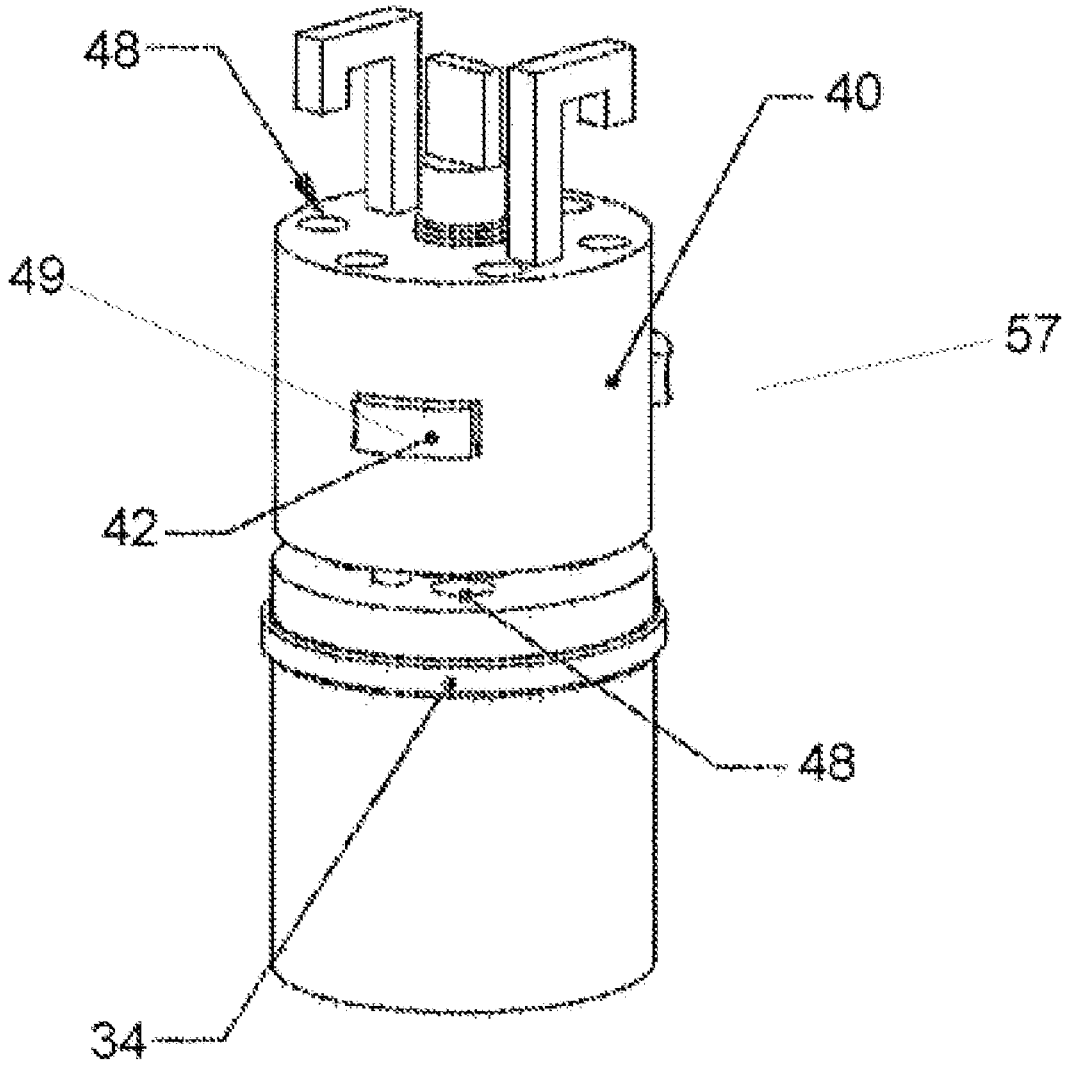
FIG. 3 is an image of a lower valve assembly in a locked position.
Figure 4:
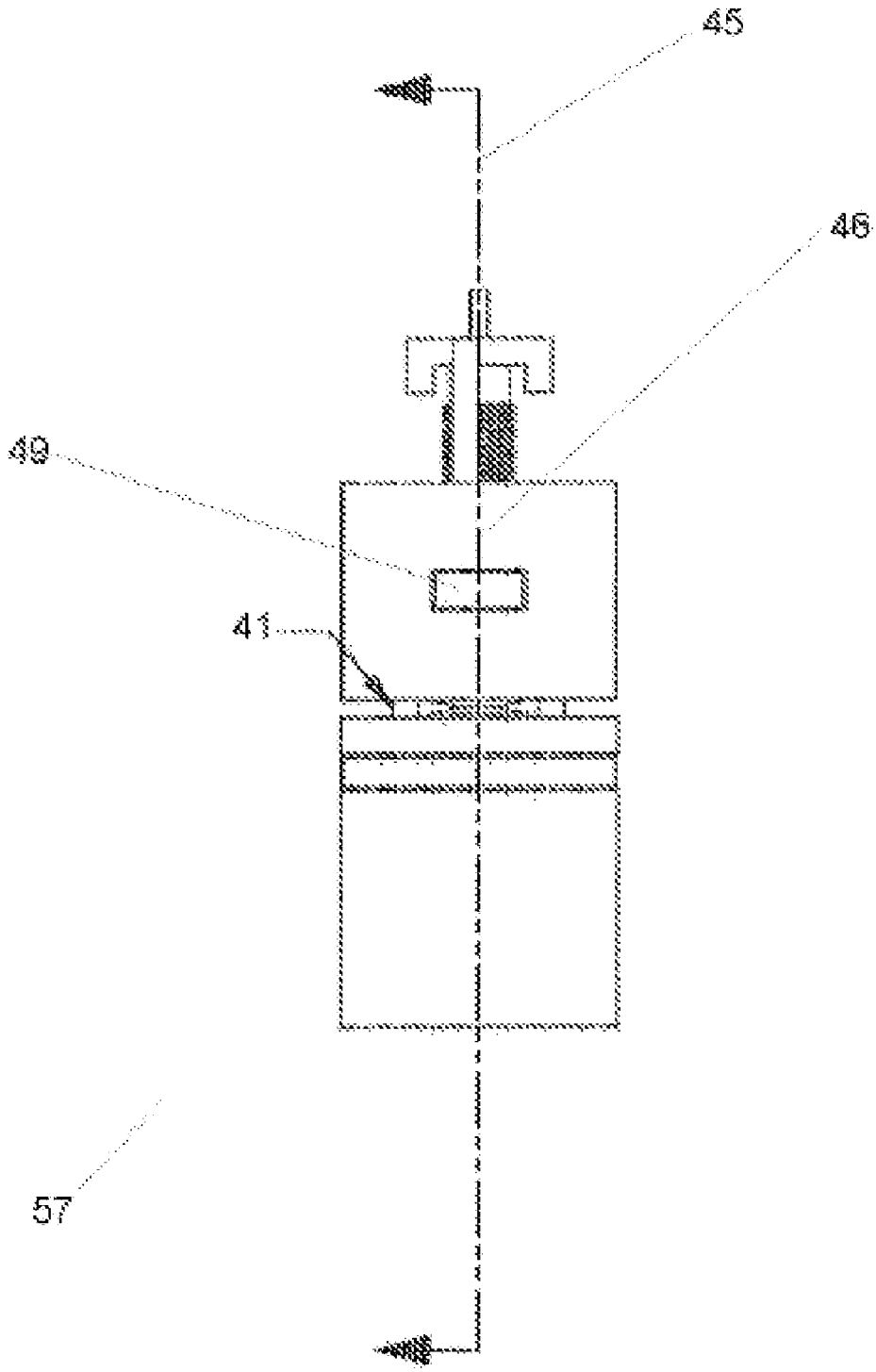
FIG. 4 is a cross-sectional view a lower valve assembly.
Figure 5:
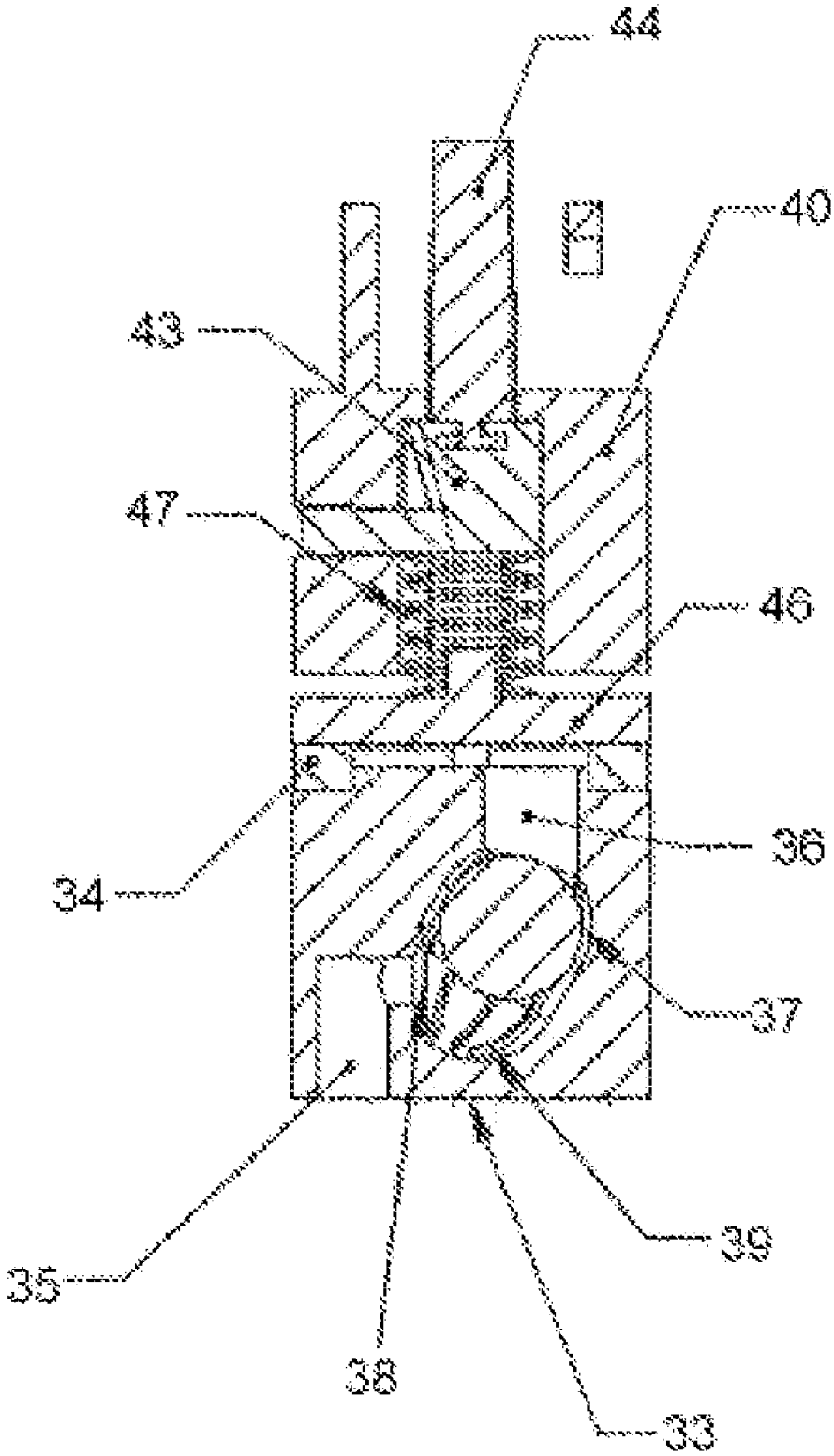
FIG. 5 is a cut away cross-sectional view of a lower valve assembly.

In at least one possible embodiment, the lower valve assembly (57) comprises a wedge drive screw (44) which the installing mechanism turns while keeping the lower valve assembly (57) stationary. One possible mechanism of keeping the lower valve assembly (57) stationary is by engagement with the lifters and spins locks (45) previously described. As shown in FIG. 2, the wedge drive screw (44) is connected by threads to the valve position lock body (40). As the wedge drive screw (44) moves down it pushes on a wedge (43) which has angled grooves/slots that retain wedge daggers (42). As shown in FIG. 3, the downward moving wedge (43) forces the wedge daggers (42) out of the position lock body (40) and into the walls of existing casing (18 of FIG. 1), locking the lower valve assembly (57) in place.

In at least one possible embodiment, the lower valve assembly (57) also comprises springs or spring washers (47). As the wedge (43) descends, it pushes on springs or spring washers (47), and applies a force to the seal push plate (46). The seal push plate (46) compresses the down hole seal member (34) forcing it out creating an oil tight seal with the existing casing (18 of FIG. 1).

The primary purpose of the lower valve assembly (57) is to separate oil and water leaving only oil above the lower valve assembly (57). This operations occurs by allowing oil through the oil in/water out bottom passage (35), the fluid channels, the oil in/water out top passage/pipe (36), and out through the oil in/water out holes (48). Once the oil has passed through the lower valve assembly (57) into the lower portion of the existing casing (18 of FIG. 1) the valve body seal (37) seals the down hole valve seal (38) separating the oil above the lower valve assembly (57) from the lower valve assembly (57) and the oil intake area. Any water that somehow has become located in the pipe (18 of FIG. 1) above the lower valve assembly (57) over time separates from the oil and travels down and out of the bottom of the lower valve assembly (57). Similarly any oil flowing into the pipe casing from the oil bearing portion of the ground below the lower valve assembly (57) over time will settle upwards and travel through the valve body seal (37) into the oil only column above the lower valve assembly (57).

In one possible embodiment, the lower valve assembly (57) prevents the upward flow of water and the downward flow of oil by the actions of a valve body seal (37) having a specific density that is lighter than water but heavier than oil. This specially designed seal opens to allow settled water and oil in through the valve. The specific density of the valve causes it to rotate into an open configuration when more dense water is above it and to rotate into a closed configuration when less dense oil is above it. In one possible embodiment the valve can rotate into an open configuration when less dense oil is below it and can rotate into a closed configuration when more dense oil is below it.

In one possible embodiment, the oil in/water out bottom passage (35) is located on the on the side of the valve body seal (37). If the oil in/water out bottom passage (35) were directly below the valve body seal (37), the settled liquid would form a pressure seal which would create a pressure barrier and would inhibit flow. This pressure barrier would be a function of the size of the opening of the oil in/water out bottom passage (35). By use of sideward positioning however, a mechanical advantage is gained because the buoyancy force of the downward flowing water or upward flowing oil does not need to counteract any pressure barrier.

Figures 6, 6A:
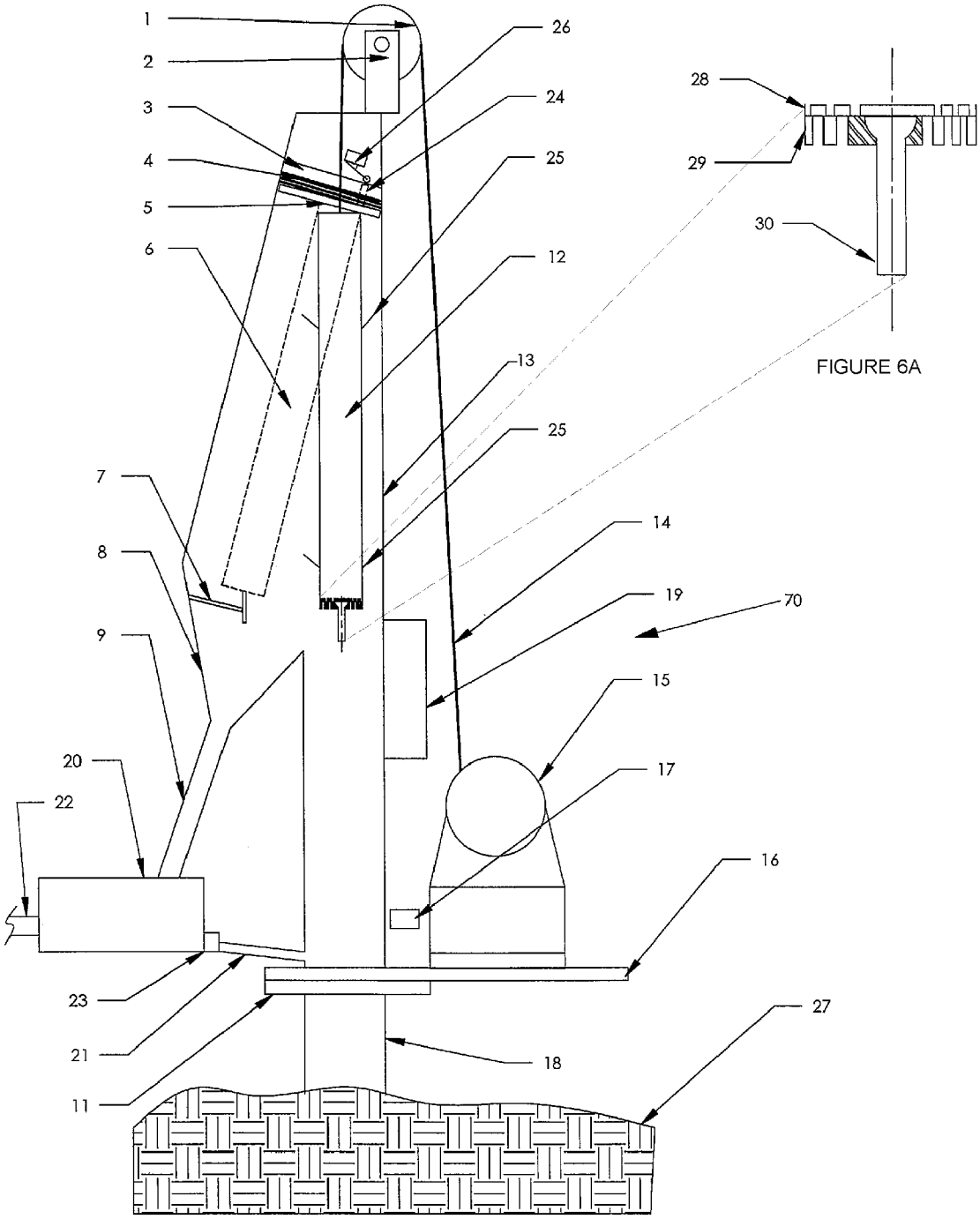
FIGS. 6 and 6A are images the upper extraction unit.

Referring now to FIG. 6 there is shown an upper extraction unit (70) capable of extracting oil from a well. In some possible embodiments, the upper extraction unit (70) will be used to extract oil from a substantially oil only column in the pipe casing (18) created by the lower valve assembly of FIGS. 2 -5. The upper extraction unit (70) encompasses a lift mechanism. Although in FIG. 6 this lift mechanism is a winch (15), this inventive concept encompasses all know equivalent lift mechanisms currently known in the art. Attached to the upper extraction unit (70) is an extraction container (12) which is lowered into and raised from the pipe casing (18) to extract oil. In at least one possible embodiment, the extraction container (12) is the device described in U.S. Pat. No. 6,615,924 all of whose embodiments are incorporated by reference into this application. In at least one possible embodiment, the extraction container is a bucket (12) as described below:

A transition section (13) is connected to the base flange (11) of the existing casing (18) of an oil well. Mounted on the top of this transition section (13) is a pulley base (2), which supports a pulley (1). The pulley (1) supports a wire rope (14) that is connected at one end to the winch (15). On the opposite end of the wire rope (14) is a bucket (12). The winch (15) pulls the wire rope (14) out moving the bucket (12) down into the oil well through the existing casing (18).

In one possible embodiment, the bucket (12) travels down the oil well at a predetermined speed to reduce aerodynamic drag. In one possible embodiment, once the bucket has traveled up through the existing casing (18) it passes the sensor (17) which reduces the speed of the winch (15).

In at least one possible embodiment, the bucket (12) can continue up at the preset slow speed until the top of the bucket (12) comes into contact with the tilted strike plate (5). The bucket (12) can then push strike plate (5), strike plate spring (4), and top of travel sensor actuator pin (26). At least one of the strike plate (5), strike plate spring (4), and top of travel sensor actuator pin (26) can be supported by limit plate (3). The limit place (3) is can be connected to and supported by the transition section (13). As this occurs, the bucket (12) moves into the tilted bucket position (6) as the top of travel sensor actuator pin (26) activates the top of travel sensor (26) stopping the winch. When so tilted and opened, the oil within the bucket (12) can be easily drained for storage.

Figure 10:
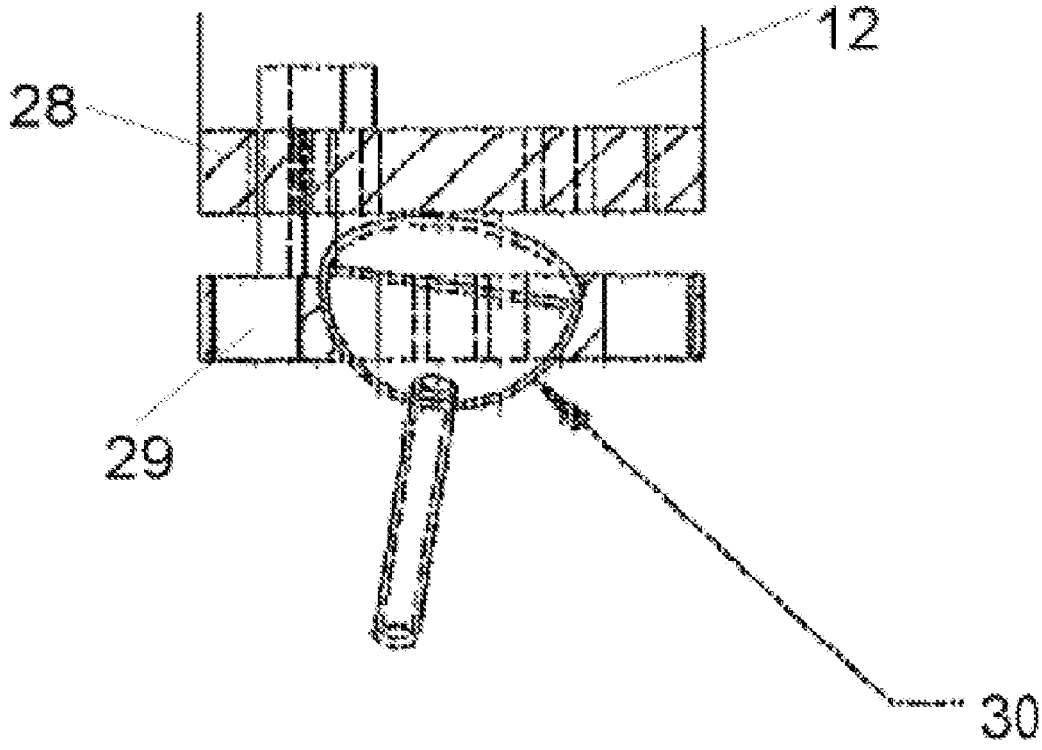
FIG. 10 is an image of a fill trigger of an extraction bucket.
Figure 11:
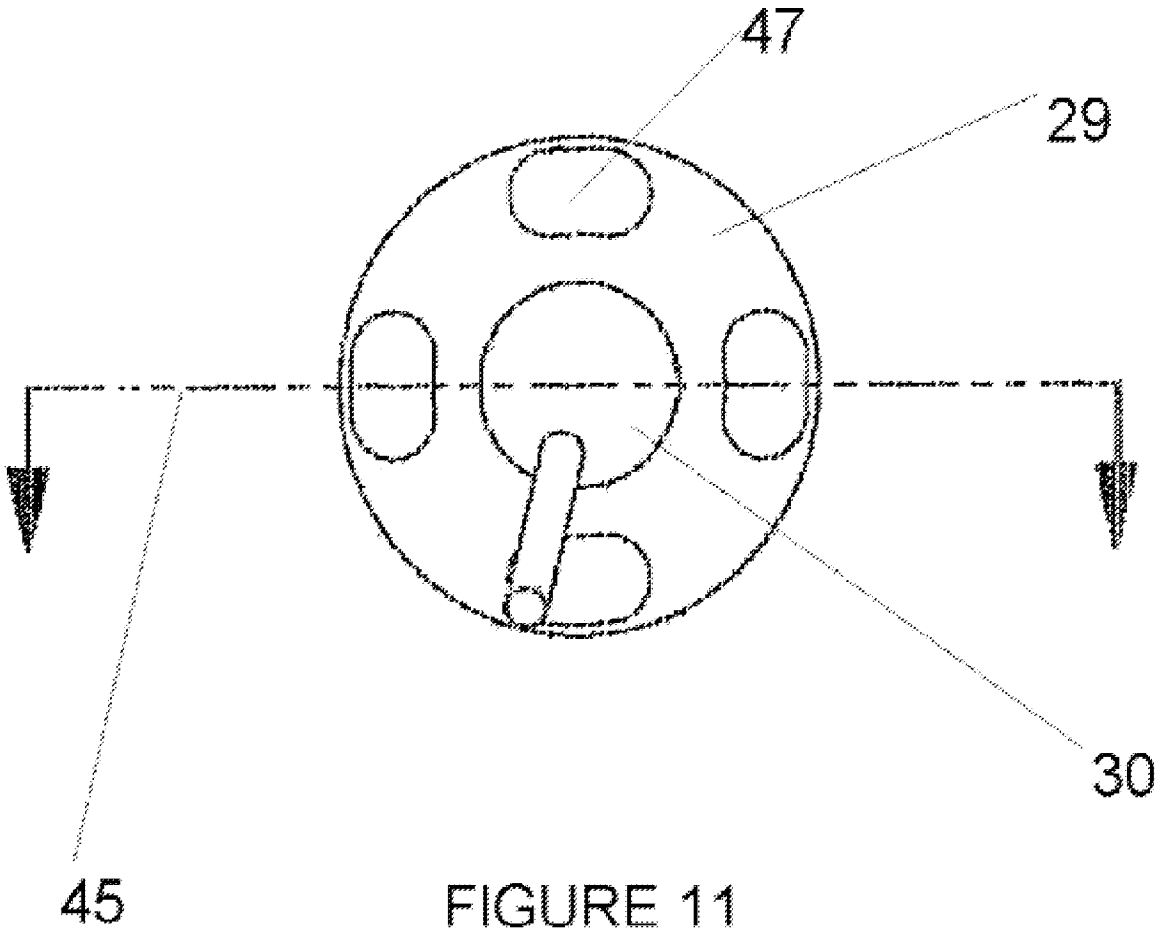
FIG. 11 is an image of a fill trigger of an extraction bucket.
Figure 12:
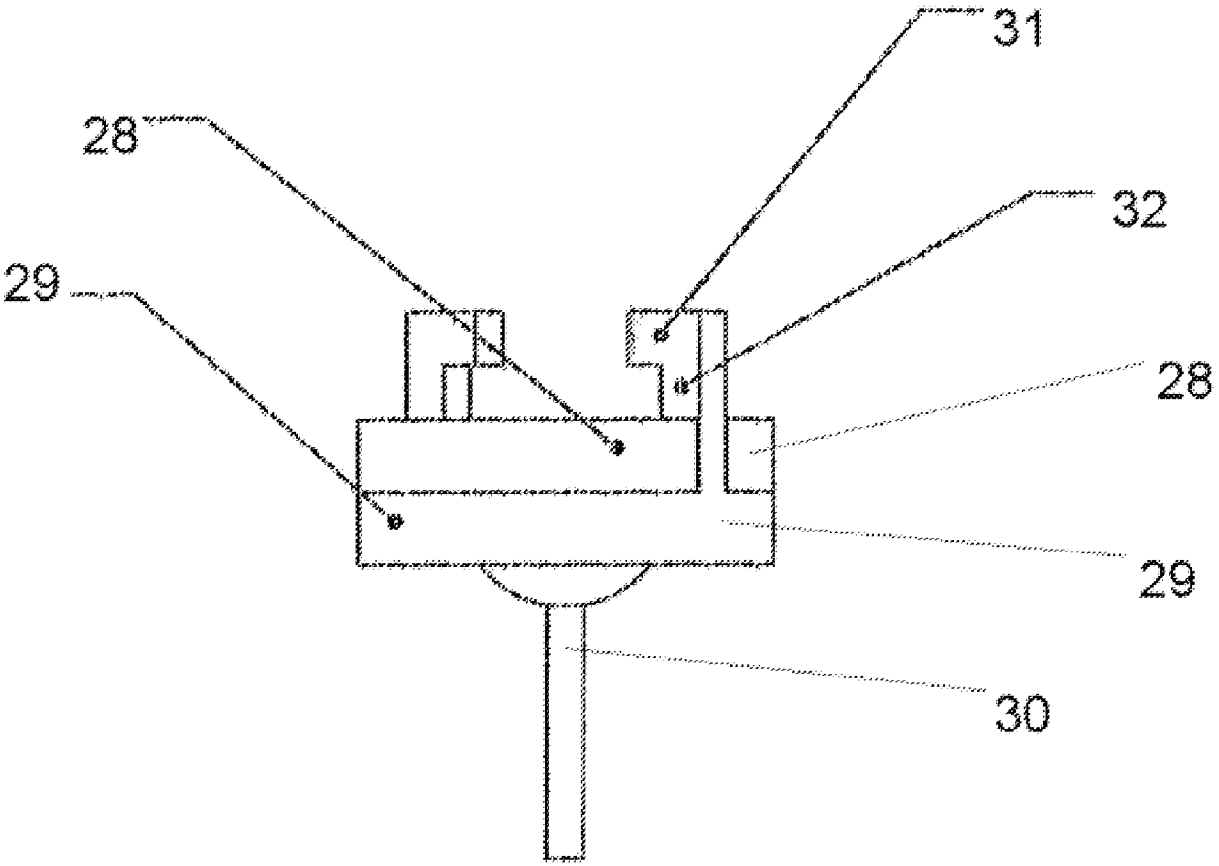
FIG. 12 is an image of a fill trigger of an extraction bucket.

As the bucket (12) descends, it eventually reaches a region of the pipe bearing oil. In one preferred embodiment, this oil bearing region is the oil column of FIG. 1. In at least one preferred embodiment, the oil bearing region is the oil column produced by a lower valve assembly (57 of FIG. 2). Referring now to FIGS. 10-12 there is shown that as the bucket (12) enters a reservoir of oil it immediately starts to fill through the fill/empty base plate (29). In some possible embodiments, the bucket (12) opens when a fill/empty trigger (30) comes into contact with an impact surface. In some possible embodiments the impact surface is the lower valve assembly (57 of FIG. 2) where the bucket can actually come to rest on the lower valve assembly (57 of FIG. 2). When making contact with the lower valve assembly (or another impact surface), the fill/empty trigger (30) is which applies a levered pushing force on fill/empty sealing member or sealing plate (28) which allows oil to continue to fill the bucket (12) along a fluid flow path (45) by passing through openings (47) in between solid portions (48) in the fill/empty base plate (29) and the sealing member or sealing plate (28). Although FIGS. 10-14 illustrate the sealing member as a flat plate, the sealing member can be of any shape or configuration and is not limited to being a plate. The pushing and filling is accomplished by transitioning from the closed valve configuration of FIGS. 12 and 13 to the open valve configuration of FIGS. 10 and 11. Once the bucket (12) has filled or once a predetermined amount of time has passed, the winch (15) pulls the bucket (12) up toward the surface. As the bucket moves up the vacuum seal (25) creates a vacuum between the bucket (12) and the lower valve assembly (57) assisting the oil rise away from the lower valve assembly (57) and up the existing casing (18) for the next cycle.

In at least one possible embodiment, the released oil drains into a collection funnel (8) and down a collection funnel pipe (9) and into a reservoir (20).

The abovementioned extraction procedure can be repeated until the well's oil yield drops below a specified amount. In one possible method of operating the marginal oil extractor, a predetermined number of buckets of oil can be required to fill the reservoir which. Waiting for this predetermined number of buckets to accumulate allows an allotted amount of time to pass so that the water and oil are able to separate. Once the water level in the reservoir (20) has reached a specific point, a water drain valve (23) can release the water into the water drain (21). This drain can allow the water to drain into the existing casing (18), and back into the well.

Figure 13:
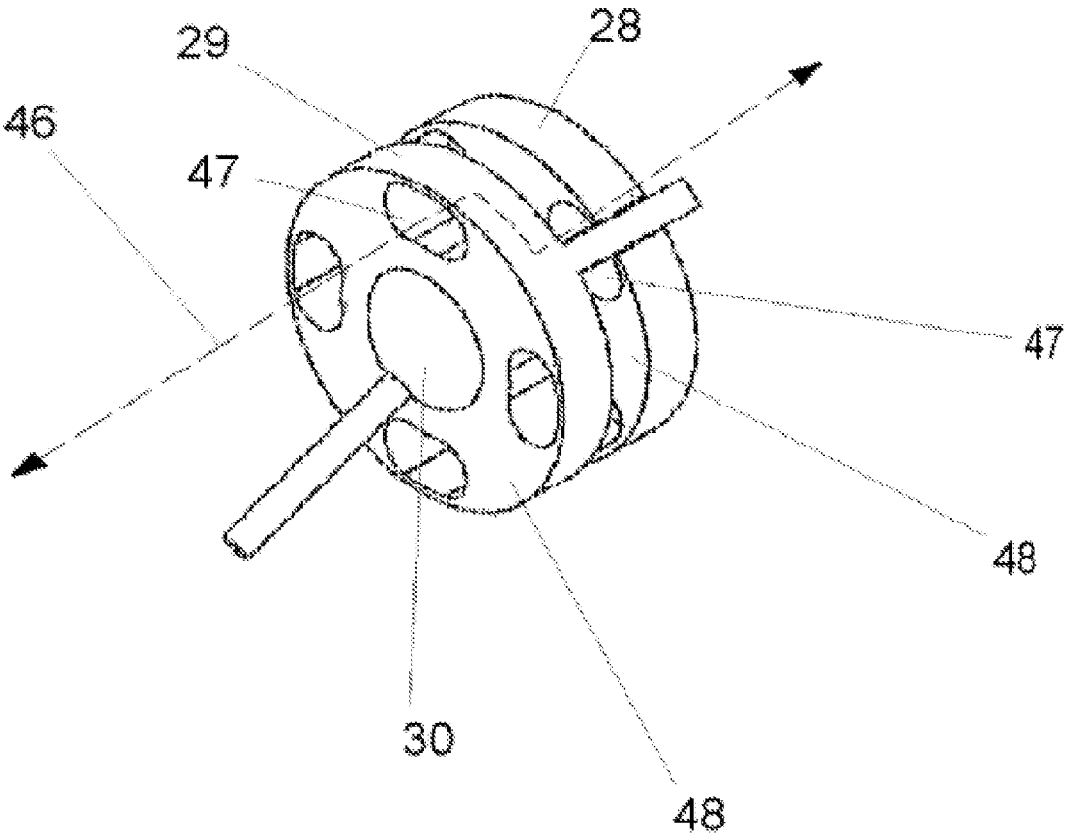
FIG. 13 is an image of a fill trigger of an extraction bucket.

Referring now to FIGS. 10-12 there is shown at least one possible embodiment directed towards the bottom of the bucket (12). Engaged to the bottom of the bucket (12) is a fill/empty base plate (29) which is freely engaged to sealing plate (28). The sealing plate (28) can move relative to the base plate (29) allowing for the formation of an opening in the bottom of the bucket (12) in response to a properly directed force. Although FIGS. 10, 12 and 13 show the fill/empty base plate (29) is freely engaged to sealing plate (28) by travel guide (32) and limited in movement by travel stop (31), this inventive concept includes any design in which a member of the bottom of the bucket can be freely moved to form an aperture. In the absence of an applied force such as when the bucket (12) is ascending or descending, fill/empty base plate (29) rests against sealing plate (28) placing the bucket into a closed configuration. When a properly applied force is exerted, the opening in the bottom of the bucket forms, allowing oil to fill the bucket when in a well, and allowing oil to drain out when the bucket is lifted out of the well.

A further efficiency in design can be realized by used the particular environments the bucket enters to open and close the bucket appropriately. In some possible embodiments (including those in which the bucket comprises freely movable sealing plates), the bucket can be so designed such that when the bucket descends, the air pressure beneath the bucket can push the bucket into an open configuration. Similarly In some possible embodiments (including those in which the bucket comprises freely movable sealing plates), the bucket can be so designed such that when the bucket fills with oil or some other liquid, the weight of the liquid can push the bucket into a closed configuration.

In at least one possible embodiment, as illustrated in FIGS. 6A and 10-12, the bucket (12) comprises a fill/empty trigger (30) pivotably engaged to fill/empty sealing plate (29) and a fill/empty sealing plate (28). When a force (such as an impact against trigger (7) of FIG. 6 or with a portion of a lower valve assembly such as those in FIGS. 2-5 and 14-15) is exerted against the fill/empty trigger (30), the fill/empty trigger (30) pivots which levers the fill/empty base plate (29) and the sealing plate (28) away from each other opening the bottom of the bucket. The fill/empty sealing plate (29) is guided by the travel guide (32) and held in place by the travel stop (31). Once the valve is open, either the oil contained in the bucket (12) can be released or the oil in the well can fill the bucket depending on where the bucket is located. The fill/empty trigger (30) can be streamlined to ease the passage of the bucket through the oil column and to reduce turbulence in the oil column.

Figure 7:
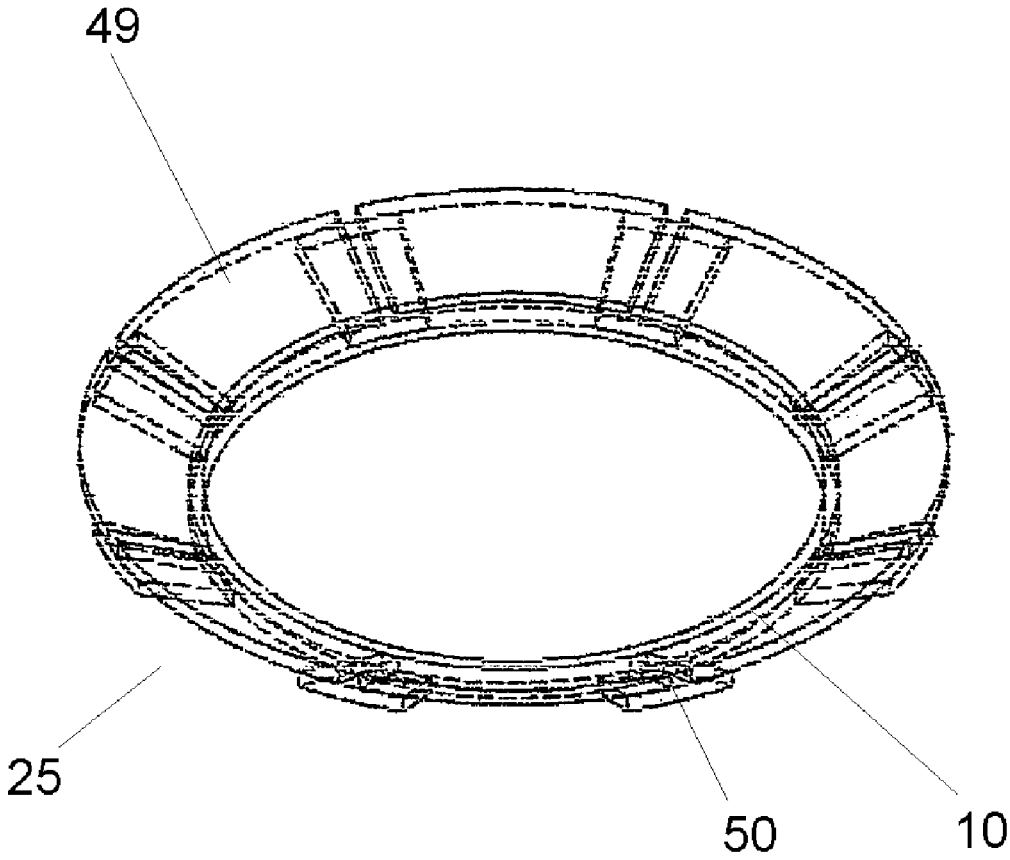
FIG. 7 is a perspective view of a vacuum seal component of an extraction bucket.
Figure 8:
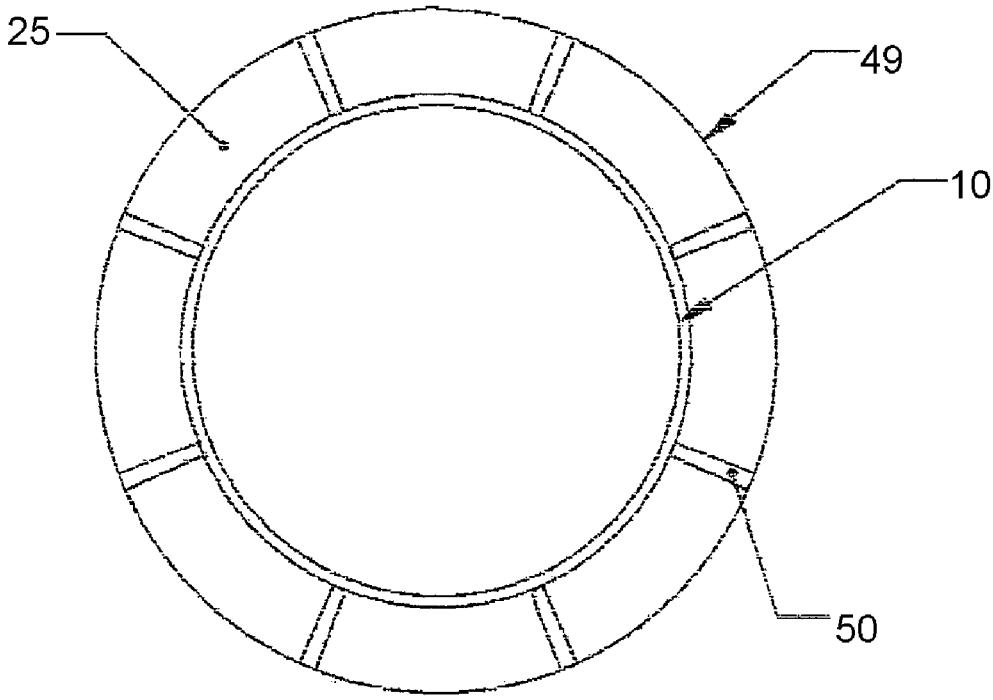
FIG. 8 is a two dimensional view of a vacuum seal component of the extraction container viewed from a vertical position.
Figure 9:
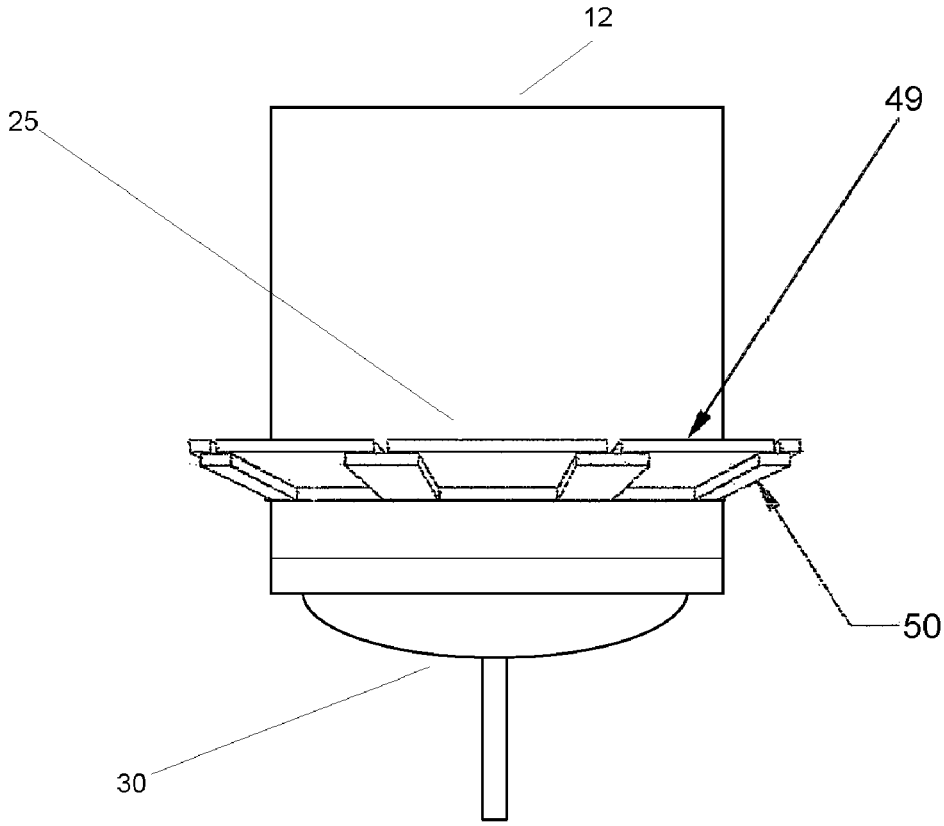
FIG. 9 is a two dimensional view of a vacuum seal a base plate component engaged to an extraction container viewed from a lateral position.

In some possible embodiments, a sealing member is engaged to the container which can regulate the flow of fluids along the outside of the container between the top and the bottom of the container. This regulation of fluids can create a vacuum/pressure differential which assists in the extraction of oil from the well. As illustrated in FIGS. 7-9, a sealing member such as a flexible vacuum seal can be engaged to the bucket (12). In one possible embodiment, the vacuum seal (25) has a vacuum seal connector ring (10) that connects the upper seal support (50) and upper seal (49) to the bucket (12). The upper seal (49) can be made of a flexible material and is supported by the upper seal support (50), which is rigid. When the bucket (12) is descending, the vacuum seal angles upwards into a vertical orientation which is more parallel (but not necessarily completely parallel) relative to the walls of the bucket (12). When the bucket (12) is ascending, the vacuum seal angles downwards into a horizontal orientation which is more perpendicular (but not necessarily completely perpendicular) relative to the walls of the bucket (12). The more perpendicular orientation creates a vacuum (or at least a pressure differential) within the pipe beneath the bucket (12). Because the distance traversed could be as quite significant (in some cases as great or possibly greater than 6000 feet), the resulting vacuum/pressure differential exerts a significant suction pressure on the fluids beneath the bucket. A sufficient vacuum/pressure differential however will be generated even in applications where a small distance is traversed. The vacuum seal can change orientation as a result of air or other fluid resistance and/or a mechanical apparatus can be engaged to the seal which can push the seal into the appropriate orientation. Although FIG. 9 illustrates the vacuum seal (25) on a bucket (12) having the fill/empty trigger device (30) described in FIG. 10, the vacuum seal is not limited to that type of bucket and can be utilized with any kind of bucket-extraction container (12).

In other possible embodiments, the sealing member can regulate the flow of fluids along the outside of the container between the top and the bottom of the container by extending or withdrawing members between the wall of the container and the wall of the well and by using mechanisms known to persons of ordinary skill in the art of increasing or decreasing drag or streamlining effects.

The resulting vacuum vacuum/pressure differential can enhance the recovery of oil from the well. In embodiments in which there is a lower valve assembly, the pressure pulls up liquid through the lower valve assembly. Once the vacuum is broken (such as when the bucket is removed from the well) the water falls back below the lower valve assembly but the oil is retained above the lower valve assembly ready for extraction. In embodiments with or without a lower valve assembly, the vacuum/pressure differential can also suction oil into the well from the oil bearing portions of the ground surrounding the well.

Figure 14:
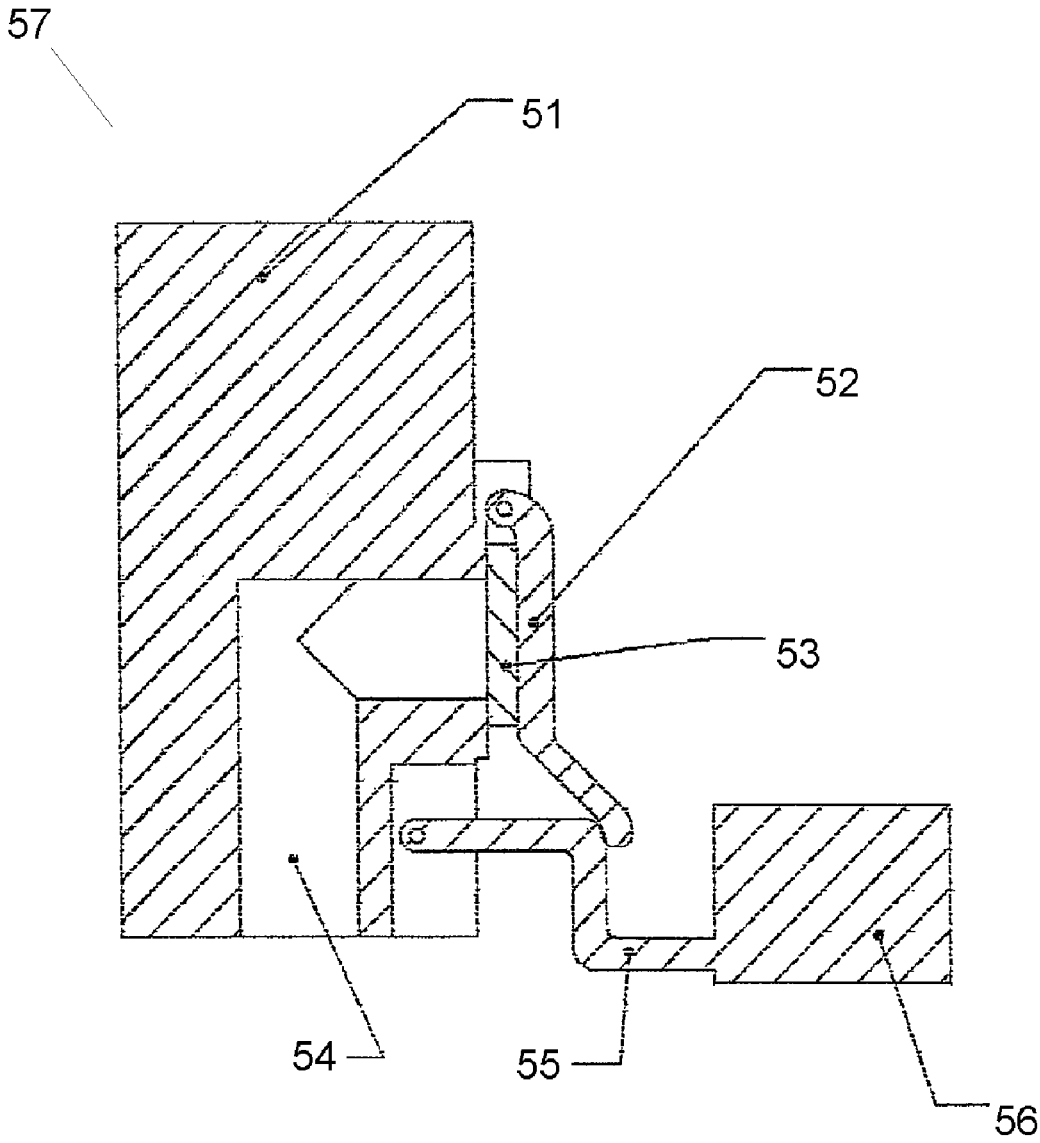
FIG. 14 is an image of an alternative design for a lower valve assembly in a closed position.
Figure 15:
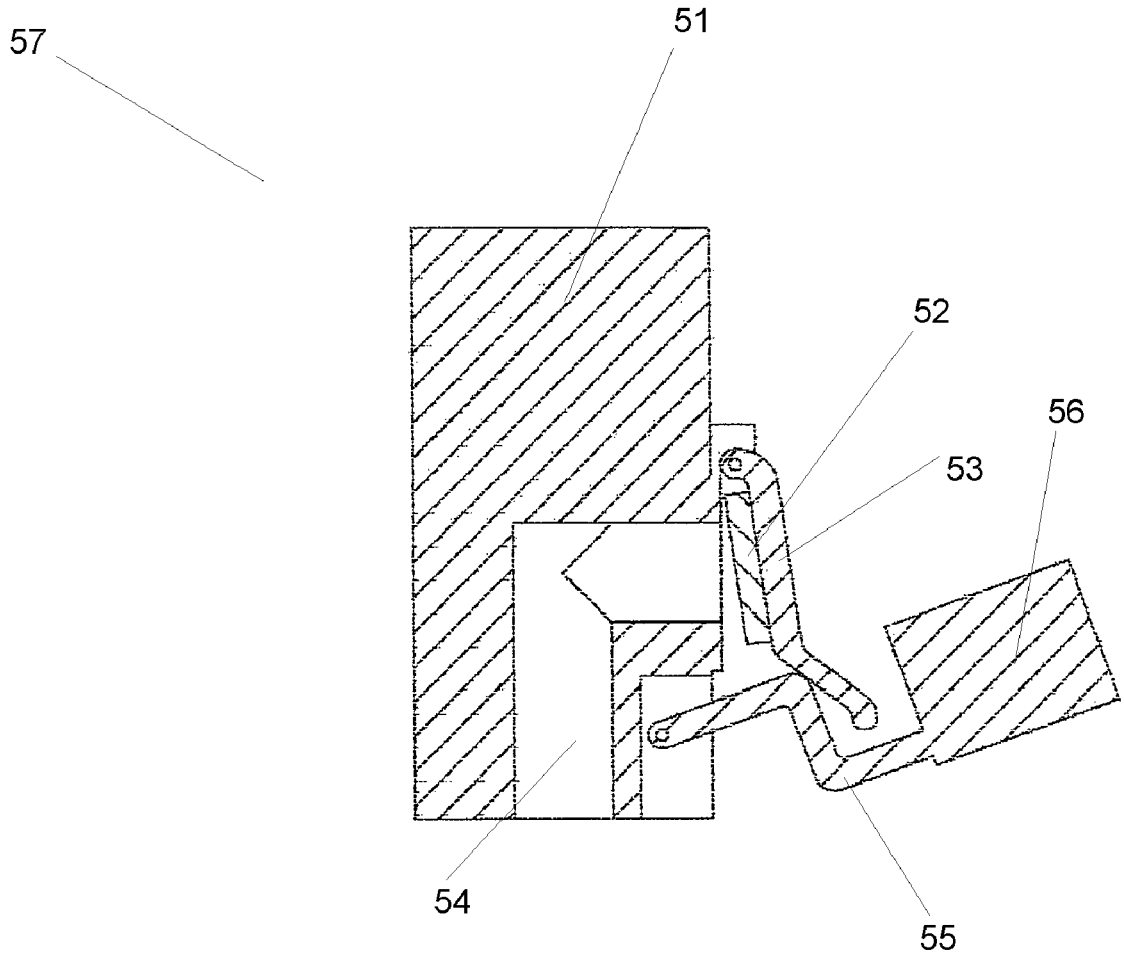
FIG. 15 is an image of an alternative design for a lower valve assembly in an open position.

In at least one possible embodiment as illustrated in FIGS. 14 and 15, the lower valve assembly (57) has the following configuration: The lower portion of the lower valve assembly (57) comprises valve configuration body (51). The oil in/water out passage (54) performs the same function as the previously mentioned oil in/water out bottom passage (35). As oil enters through the oil in/water out passage (54) it forces a flapper valve seal (53) and a flapper valve (52) to open. The oil passes through the oil in/water out top passage (36) and out through the oil in/water out holes (48). Once the oil has passed through the lower valve assembly (57) into the lower portion of the existing casing (18 of FIG. 1), the flapper valve seal (53) seals valve configuration body (51). This separates the oil in the existing casing (18) from the oil reservoir outside and below the lower valve assembly (57). As the oil has time to settle the water and oil separate and the water travels down to the bottom. Float (56) has a specific density that is lighter than water but heavier than oil, so that when the oil and water separate the float (56) moves up pivoting on the float support (55). As the float support (55) pivots it engages with the flapper valve (52) and opens to let the settled water out through the oil in/water out passage (54).

In at least some possible embodiments, some or all of the sequences of operations of this marginal oil extraction system can be controlled via computer. The computer can controls and monitor the following: time to reach bottom, time to reach top, number of strokes/day, KWH/day/week/month, barrels/day, emergency shut off, alarm system, power failure recover and notification, remote operation, automatic or manual control, end of spool sense, spool motion sense, sump level sense and control, LED status indicators, automatic cycle adjustment per well oil capacity, automatic stop, and periodic data uploaded to host for analysis. In at least one possible embodiment the marginal oil extraction system utilizes at least some of the computer operations disclosed in U.S. Pat. No. 6,615,924 all of whose embodiments are incorporated by reference into this application.

This completes the description of the preferred and alternate embodiments of the invention. The above disclosure is intended to be illustrative and not exhaustive. This description will suggest many variations and alternatives to one of ordinary skill in this art. The various elements shown in the individual figures and described above may be combined, substituted, or modified for combination as desired. All these alternatives and variations are intended to be included within the scope of the claims where the term "comprising" means "including, but not limited to".

The invention claimed is:

1. A lower valve assembly capable of being installed within an oil pipe casing, the valve assembly having:

a body with an interior, a top, and a bottom;

a through passage extending through the body from an upper opening to a lower opening; and a seal;

the through passage having at least two segments each having portions and each being in fluid communication with each other, the at least two segments comprising a first segment and a second segment, the first segment defining a section of the through passage extending from the upper opening down into the interior and the second segment defining a section of the through passage extending from the interior to the lower opening, the seal being engaged to and in fluidic communication with both the first and the second segments, the portions of the first segment and second segment engaged to the seal being in a non-linear orientation relative to each other, the seal having a specific density greater than water but less than oil the seal having an open configuration allowing for the passage of fluid and a closed configuration preventing the passage of fluid, the seal assumes an open configuration in response to the buoyant forces produced when in contact with water, and assumes a closed configuration in response to the anti-buoyant forces produced when in contact with oil.

2. The lower valve assembly of claim 1 further comprising spin locks engaged to the body, a wedge screw in mechanical communication with a wedge screw drive, and wedge grapplers, the wedge grapplers having two configurations a contained configuration in which the grapplers are substantially contained within the body and an expanded configuration in which the grapplers extend out of the body and engage the inner surface of the oil pipe casing.

3. The lower valve assembly of claim 1 wherein said seal is a rotating seal, the seal assumes the open configuration when the seal is rotated in a first direction in response to the buoyant forces produced when in contact with water, and assumes the closed configuration when the rotating seal is rotated in a second direction in response to the anti-buoyant forces produced when in contact with oil.

4. The lower valve assembly of claim 1 wherein said seal is a floating seal, the floating seal has a density greater than water but less than oil, the floating seal assumes the open configuration when the floating seal is lifted by the buoyant forces produced when in contact with water, and the floating seal assumes the closed configuration when the floating seal sinks in response to the anti-buoyant forces produced when in contact with oil.

* * * * *